US006405850B1

(12) United States Patent
Jackson et al.

(10) Patent No.: US 6,405,850 B1
(45) Date of Patent: Jun. 18, 2002

(54) APPARATUS AND METHOD FOR ADVANCING SIGNATURES USING A RETRACTING DRIVE

(75) Inventors: Barry Mark Jackson, York, ME (US); David Elliott Whitten, Barrington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/282,870

(22) Filed: Mar. 31, 1999

(51) Int. Cl.[7] ..... B65G 47/31

(52) U.S. Cl. ..... 198/462.3; 198/461.3; 198/577; 271/270; 271/202

(58) Field of Search ..... 271/270, 272, 271/182, 202; 198/462.1, 462.3, 577

(56) References Cited

U.S. PATENT DOCUMENTS 3,284,081 A * 11/1966 Huck ..... 271/64
3,601,241 A * 8/1971 Kuhnt et al. ..... 198/20
3,685,823 A * 8/1972 Chombon ..... 271/80
3,793,927 A * 2/1974 Emond ..... 93/33 H
3,794,417 A * 2/1974 Machmer ..... 271/57
4,365,552 A * 12/1982 Besemann ..... 271/182
4,601,387 A * 7/1986 Kobler ..... 198/626
5,265,861 A * 11/1993 Schaffner et al. ..... 271/182
5,599,015 A * 2/1997 Shimizu et al. ..... 271/272
5,803,450 A 9/1998 Brokate et al.

* cited by examiner

*Primary Examiner*—Thomas J. Brahan
(74) *Attorney, Agent, or Firm*—Kenyon & Kenyon

(57) ABSTRACT

An apparatus and method for advancing and/or slowing signatures in a printing press. The apparatus and method includes a series of two or more belt drives, where each belt drive includes at least a pair of opposed belts. The belts are preferably timing or toothed belts driven by sprockets. The sprockets are formed with a semi-elliptical outer surface. As a result, the belts have two directions of motion. The first direction—horizontal—advances the signatures and may be used to slow the signatures. The second direction—vertical—withdraws the belts away from contact with the signatures to prevent buckling or wrinkling during a speed transition or during a transfer between belts. In one embodiment of the present invention, both opposed belts are retracting belts; in another embodiment, one belt is a fixed conveyor belt, while the other opposed belt is a retracting belt. The apparatus can be formed of a series of sequential belts running at different speeds, or a slower set of belts could be located inside the faster set of belts. In another embodiment, the upper and lower belts can be offset relative to one another to create an S-wrap along the signature, thereby compensating for different thicknesses of the folded signature.

30 Claims, 8 Drawing Sheets

APPARATUS AND METHOD FOR ADVANCING SIGNATURES USING A RETRACTING DRIVE

BACKGROUND OF THE INVENTION

1. Field of the Invention

The present invention relates to an apparatus and method for advancing signatures used in printing presses. In particular, the present invention relates to an apparatus and method for slowing signatures after folding which eliminates buckling and wrinkling.

2. Description of the Prior Art

In printing presses, it is known to process signatures after printing using a folding apparatus, to provide one or more folds in the printed signatures. After folding, it is desirable to slow the speed of the folded signatures and/or advance the folded signatures to other portions of the press for further processing.

Tail snubbers are a prior art mechanism which have been used to slow signatures emerging from a folding apparatus. Tail snubbers create a nip through some portion of their rotation, usually 90°, to thereby grasp a passing folded signature in the nip. Tail snubbers are designed to grasp a signature at its trailing or tail end, and have a linear speed which is slower than the speed of the signature. This slower speed of the tail snubbers causes the folded signature to slow down when it is grasped in the nip.

SUMMARY OF THE INVENTION

One disadvantage of the use of tail snubbers to slow and/or advance signatures is that they can cause buckling or wrinkling of the folded signatures. The buckling or wrinkling of the folded signatures results when a folded signature driven on a tape has its tail end grasped by the nip of a slower-moving tail snubber, resulting in two different speeds being applied to portions of the folded signatures. Buckling of the signatures can result in unwanted creasing or folding of the signatures, and can also result in jamming of the signatures in the press. In addition, tail snubbers are disadvantageous because they require that a lateral adjustment be made of the position of the tail snubber every time a new signature size is used, so that the tail snubber is positioned to grasp the tail end of the folded signature of a particular length.

The present invention is an apparatus and method for advancing and/or slowing signatures in a printing press which eliminates disadvantages in prior art signature-advancing and slowing mechanisms. The apparatus and method includes a series of two or more flexible mechanical drives, such as belt drives or chain drives, where each drive includes at least a pair of opposed belts. The belts are preferably timing or toothed belts driven by sprockets. The sprockets are formed with a partial out-of-round surface, preferably a semi-elliptical outer surface. Preferably, two sprockets are used for each belt or chain, and the sprockets both have a semi-elliptical outer surfaces driven in phase with one another, and also have a 1:1 diameter ratio. As a result of these features, the belts or chains have two directions of motion. The first direction of motion of the belts or chains—horizontal—advances the signatures and may be used to slow the signatures. The second direction of motion of the belts or chains—vertical—retracts the belts or chains away from engagement with the signatures. Retracting the belt from engagement with the signatures prevents buckling or wrinkling during a speed transition or during a transfer between belts.

One of the sprocket shafts may be fixed, while the other sprocket shaft may be movable or float, so that the tightness or tension of the belts may be adjusted. In one preferred embodiment, sprockets may be used which are fabricated from standard, circular timing belt sprockets which have had one side ground or otherwise machined to a semi-elliptical shape. The use of a semi-elliptical shape ensures that the pitch length of the belt remains constant throughout its movement through a complete cycle, and as a result, there is no change in tension in the belt. The design of the apparatus of the present invention therefore requires no mechanism to compensate for tension changes, which could cause unwanted vibrations. The teeth on one side of the sprockets positively drive the timing belts during a rotation, while slip occurs between the timing belts and the semi-elliptical side of the sprockets, from the velocity difference due to the changing radius.

The sprockets which drive the belts may in turn be driven by a driving mechanism, which can be in the form of a driven belt with its own tensioner. Other drive mechanisms, such as gears or motors, could also be used to drive the sprockets of the present invention.

In the method of the present invention, signatures are fed between two opposed belts, at least one of which is retractable, i.e., movable in two directions. The signatures are advanced by the belts during the one-half rotation of the sprockets at which the belts are in an extended or engaged position. During the other one-half of a rotation of the sprockets, at least one of the belts is retracted and disengaged from the signature, allowing the signature to be engaged by another pair of opposed belts without buckling or wrinkling caused by an engagement of an end of the signature with the first opposed belts.

The device of the present invention may be adapted to ensure that the speed at which the belts advance the signatures is optimal, and the rate at which the belt retracts or disengages from the signatures is also optimal. The size and shape of the sprockets will dictate these parameters. The advancing speed at which the signatures are driven is a function of the pitch diameter of the sprocket. The rate at which the belt retracts or disengages from the signatures will be a function of the semi-elliptical profile of the sprockets.

The sprockets driving a particular belt are arranged so that they are always in phase with one another, i.e., the toothed side on one sprocket is always facing in the same direction as the toothed side of any other sprocket for that belt. In this way, the tension in the belt is maintained, as the same number of sprocket teeth—one-half of a sprocket circumference—are engaged with the belt through the entire rotation of the sprockets. This ensures a positive drive of the belts, and thus a positive drive of the signatures, throughout the rotation of the sprockets without any change in the surface speed of the belts.

The major axis of the semi-elliptical surface on the sprockets is equal to the diameter of the sprocket measured from the bottom of the teeth of the sprocket. The minor axis of the semi-elliptical surface is calculated so that the arc length of the semi-elliptical surface is equal to a distance of any integer number of teeth on the belt. This arc length can be varied to any number which produces the desired amount of vertical lift of the belt which is required for the particular design or operating conditions.

In one embodiment of the present invention, both opposed belts are retracting belts; in another embodiment, one belt is a fixed conveyor belt, while the other opposed belt is a retracting belt. The apparatus can be formed of a series of sequential belts running at different speeds, thereby resulting in the speeding up or slowing down of the signatures as they pass from belt to belt. Alternatively, instead of using a series of sequential belts, the slower set of belts could be located inside the faster set of belts. In another embodiment, the upper and lower belts can be offset relative to one another to create an S-wrap along the signature, thereby compensating for different thicknesses of the folded signature.

BRIEF DESCRIPTION OF THE DRAWING

The foregoing and other features of the present invention will become apparent to those skilled in the art to which the present invention relates from reading the following description with reference to the accompanying drawings, in which.

DETAILED DESCRIPTION OF THE INVENTION

Figure 1A:
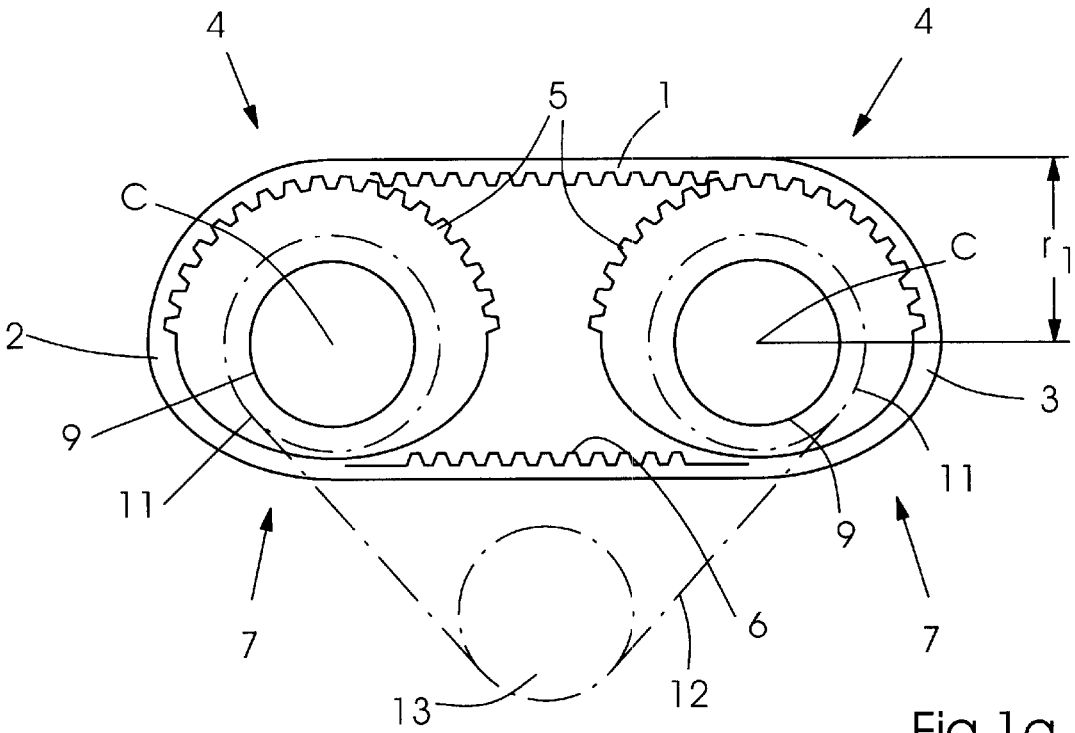
FIG. 1*a* is an elevation view of a belt and drive of the present invention, with the belt in an engaged or extended position.
Figure 1B:
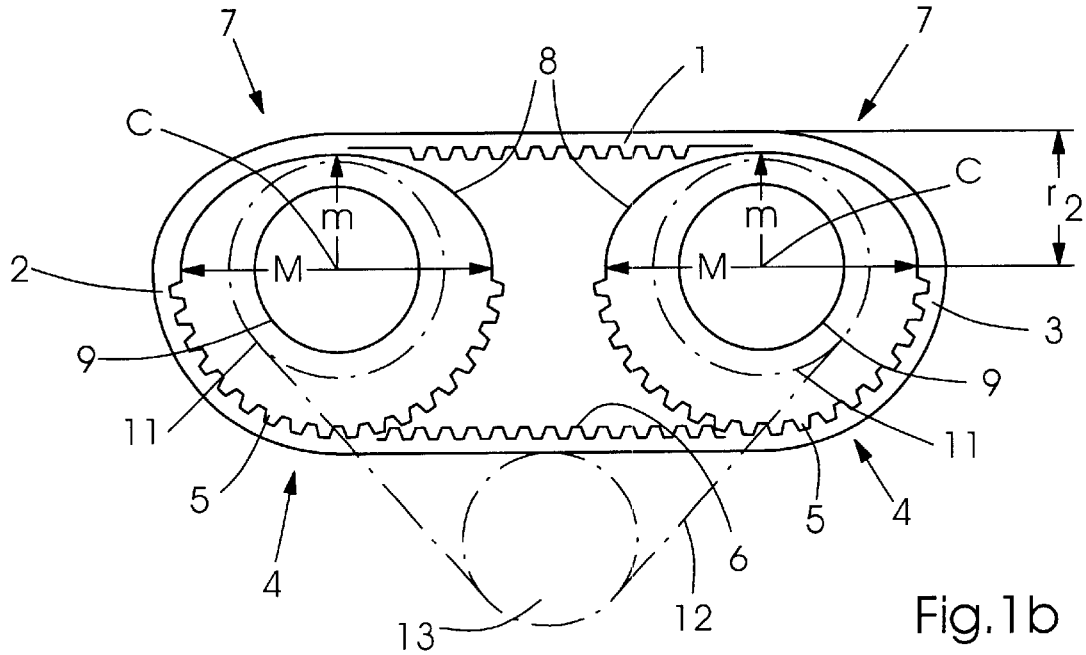
FIG. 1*b* is a belt and drive of the present invention, with the belt in a disengaged or retracted position.

FIGS. 1*a* and 1*b* show views of a belt and drive used in preferred embodiment of the signature advancing apparatus of the present invention. A flexible mechanical element, preferably in the form of a toothed timing belt 1, is fitted over sprockets 2, 3. One semicircular side 4 of each of the sprockets 2, 3 has teeth 5, which are engaged with the teeth 6 on belt 1. The other side 7 of each of the sprockets 2, 3 has a surface 8 which is semi-elliptical. Side 4, as a result, drives the belt 1 to travel along a radius $r_1$ relative to a center C of sprockets 2, 3, through 180° of its circumference. Semi-elliptical side 7 has a major axis M—with a radius equal to the radius of the sprocket side 4 measured from the bottom of the sprocket teeth—and a minor axis m—with a radius less than the radius of the major axis M. Semi-elliptical side 7, as a result, drives the belt 1 to travel between radius $r_1$ and a radius $r_2$—less than radius $r_1$—relative to a center C of sprockets 2, 3, through 180° of its circumference. As a result of the minor axis m of semi-elliptical side 7, the belt 1 is retracted relative to its position at radius $r_1$.

Figure 3A:
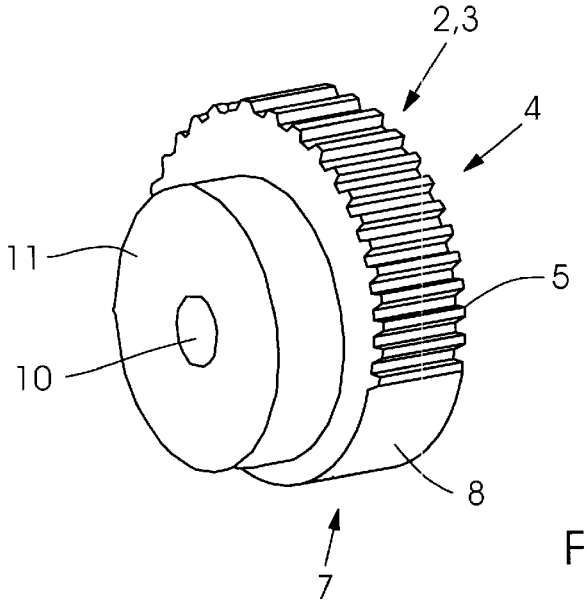
FIGS. 3*a*, 3*b* and 3*c* are perspective, top plan and side elevation views of a sprocket of the present invention.
Figure 3B:
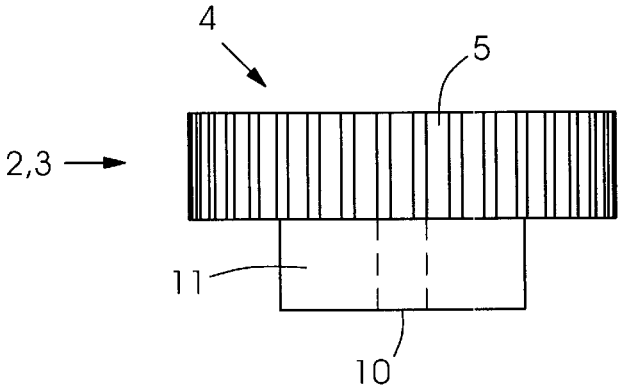
Figure 3C:
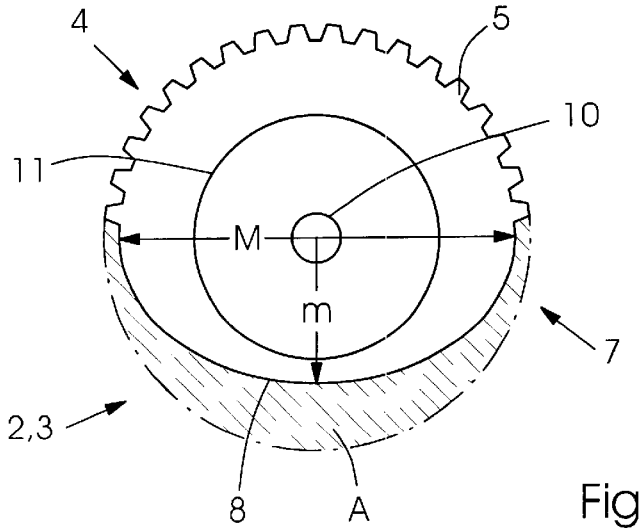

In a preferred embodiment of the invention, sprockets 2, 3 are formed by taking a conventional timing sprocket of uniform radius and grinding or machining off the teeth 5 on one side. Thereafter, that side is further ground or machined so that a semi-elliptical side is formed having a major axis M, and a minor axis m having a radius less than radius of the major axis M. FIG. 3*c* shows, in shading, the area A that is ground or machined from a conventional sprocket to form the sprockets 2, 3 of the present invention. The major axis M is equal to the diameter of the sprockets 2, 3 as measured at the bottom of the sprocket teeth. The radius of the minor axis m is calculated to allow for proper movement and tensioning of the timing belt 1. The minor axis m must be selected to be of a value such that the arc length of the surface 8 is equal to a length of the timing belt 1 corresponding to any integer number of teeth 6.

The sprockets 2, 3 are each mounted on rotating shafts 9, which may be inserted and secured in a shaft mounting hole 10 through the center C of the sprockets 2, 3. In a preferred embodiment, one of the shafts 9 is mounted for rotation in a fixed bearing 20, while the other shaft 9 is mounted in a bearing 21 which is movable or floats (such as a bearing which may slide within, and thereafter be secured to, a slot 22). The use of a bearing 21 which is movable or floats, which bearing 21 is known in the art, allows the belt 1 initially to be mounted loosely on the sprockets 2, 3, and then allows one of the sprockets 2 to be moved relative to the other sprocket 3 so that the belt may be tightened or tensioned.

The sprockets 2, 3 may also include a hub 11. A drive belt 12 (FIGS. 1*a* and 1*b*) may be fitted around the hubs 11 of both sprockets 2, 3 and also around a tensioner 13. Any suitable drive mechanism, such as a rotary motor, may be used to drive the drive belt 12. As an alternative, drive belt 12 could be eliminated, and any other suitable drive mechanism, such as gears or motors, could be used instead to drive the sprockets 2, 3 in direction R.

The hubs 11 must also have a 1:1 diameter ratio, so that the drive belt 12 drives the sprockets 2, 3 at identical rotational speeds. Additionally, the sprockets 2, 3 must be oriented in bearings 20, 21 so that they are in phase with one another, i.e., the major axes M are aligned in the position shown in FIGS. 1*a* and 1*b* and the sides 4 must both be oriented in the same direction. The in-phase arrangement of the sprockets 2, 3 is shown in FIGS. 1*a*, 1*b* and 2, and is required to keep the belt tension constant and thereby to prevent belt 1 slippage or binding.

Figure 2:
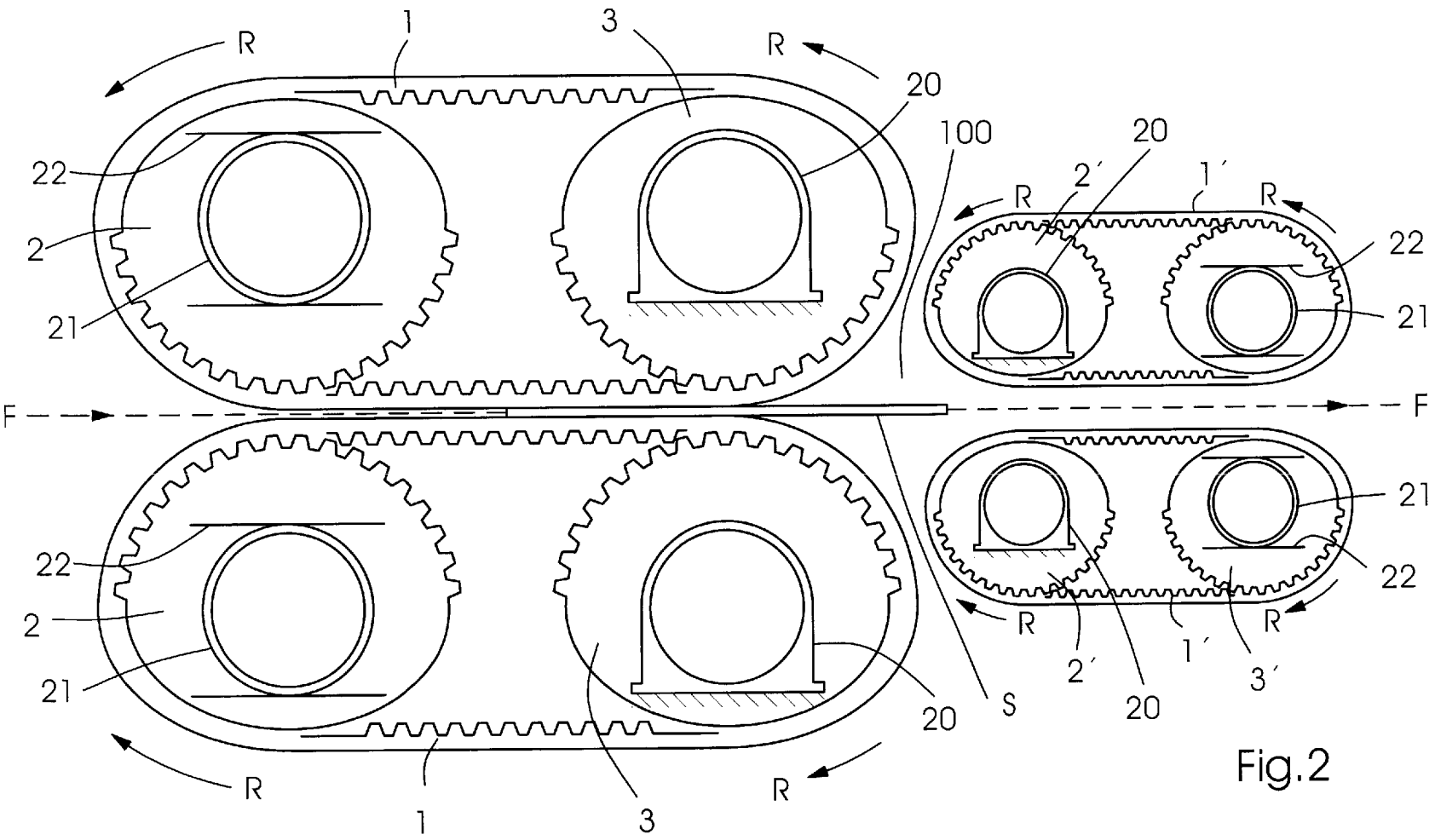
FIG. 2 is an elevation view of a series of belts and drives of the present invention advancing a signature.

FIG. 2 shows a first embodiment in which a series of first opposing belts 1 and second opposing belts 1' are used to slow down and advance a signature S without buckling or wrinkling. Signatures S are fed in a direction F from a printing press component, such as a folder, to a location between upper and lower first opposing belts 1. First opposing belts 1 are fitted around sprockets 2, 3. As shown in FIG. 2, the first upper sprockets 2, 3 and first lower sprockets 2, 3 are phased so that the first opposing upper and lower belts 1 are in the extended or engaged position simultaneously (relative to one another), and conversely, in the retracted or unengaged position simultaneously. As a result, a signature S is clamped between the first opposing upper and lower belts 1 and driven in the direction F by rotation of the first sprockets 2, 3 in rotation direction R. FIG. 2 shows a signature S emerging from the outlet of the first opposing belts 1 and being fed into the inlet of the second, aligned, opposing belts 1'. Second, aligned, opposing belts 1' are longitudinally aligned along direction F with first opposing belts 1.

As shown in FIG. 2, the second, aligned, opposing belts 1' are in a retracted or unengaged position when the first opposing belts 1 are in an extended or engaged position. This condition is achieved by phasing the second sprockets 2', 3'

180° out of phase with the first sprockets 2, 3. In order to ensure that this phase relationship is maintained, the first sprockets 2, 3 and second sprockets 2', 3' are driven at identical rotational speeds. As a result, as the signature S emerges from the outlet of the first opposing belts 1—gripped by the first opposing belts 1—it is fed into the inlet of the second aligned opposing belts 1' with the second aligned opposing belts 1' in a retracted position. As a result, the signature S is fed from the first opposing belts 1 to the second aligned opposing belts 1' without contacting the second aligned opposing belts 1' while still gripped by the first opposing belts 1. Therefore, any difference between the linear velocity of the first opposing belts 1 and second aligned opposing belts 1' will not cause buckling in the signature S as it is fed to the second aligned opposing belts 1'. The second aligned opposing belts 1' will thereafter extend to clamp the signature, while at the same time the first opposing belts 1 will retract to release the signature S. Therefore, at no time is the signature S subjected to clamping by both sets of opposing belts 1, 1', and the differences in linear velocities of those belts will not cause buckling or wrinkling of the signature S. Any minor velocity differences at the instant of transfer is taken up in the space 100 between both sets of opposing belts 1, 1'.

In the system shown in FIG. 2, the second aligned opposing belts 1' are driven on smaller second sprockets 2', 3' than the first opposing belts 1. As a result, when the first sprockets 2, 3 and second sprockets 2', 3'are driven at the same rotational speed, the second aligned opposing belts 1' will transport the signature S at a slower linear speed. The system shown in FIG. 2, therefore, slows down or decelerates the signatures S as they are advanced in the direction F. As discussed above, this deceleration and advancement is achieved without the potential for buckling of the signatures S as they are advanced.

Figure 4:
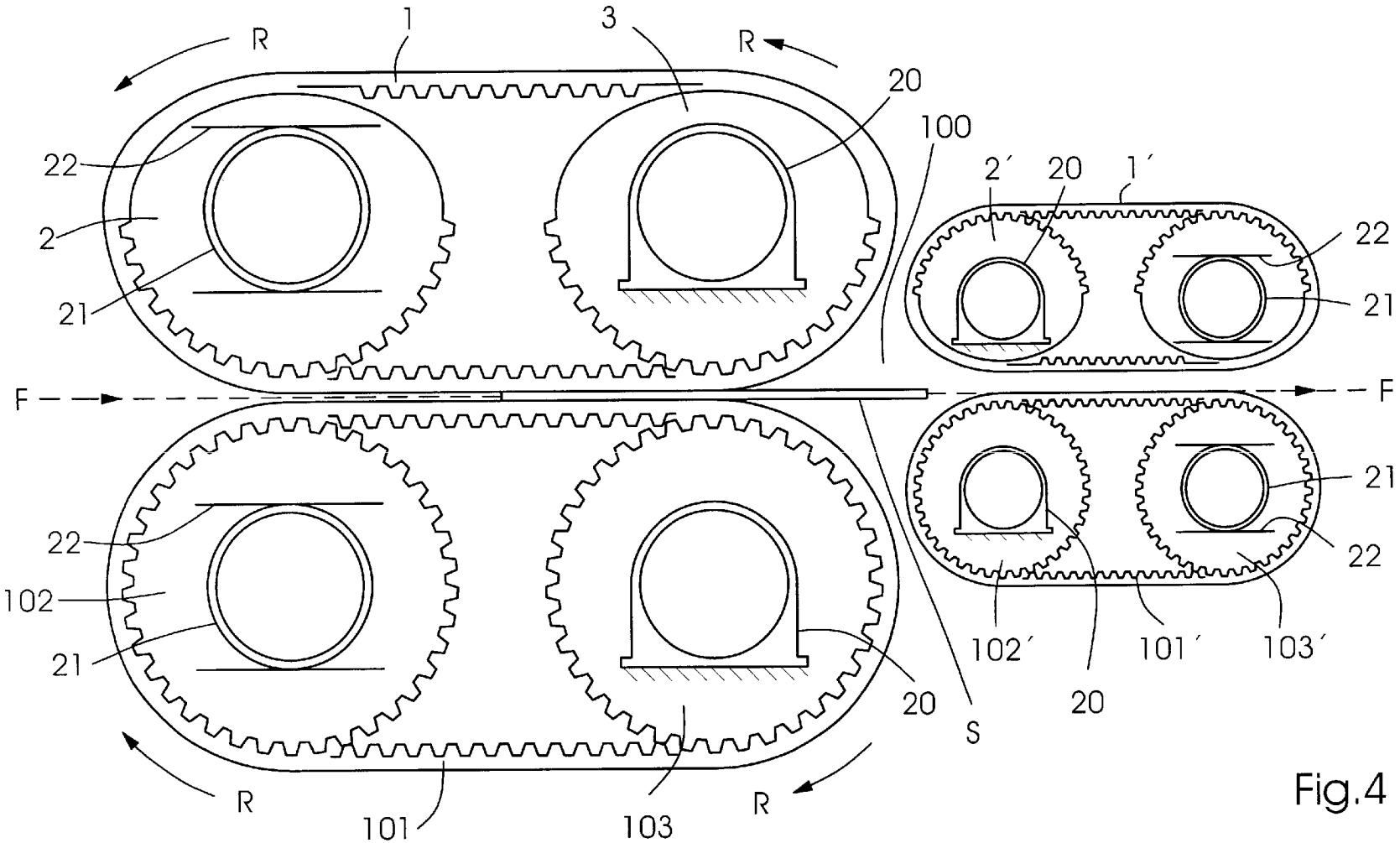
FIG. 4 shows an elevation view of a second embodiment of a series of belts and drives of the present invention advancing a signature.

FIG. 4 shows an alternative embodiment of the invention in which only one belt 1, 1' of the first and second belts is a retracting belt. The other belt 101, 101' is a standard timing belt which is driven by a standard timing sprocket 102, 103 or 102', 103'. As may be seen in FIG. 4, this arrangement, like the arrangement of FIG. 2, ensures that when the belts 1, 1' are in the extended or engaged position, the signature S is gripped between and advanced by the belts 1, 101 or 1', 101' and also ensures that when the belts 1, 1' are in a retracted or disengaged position, a signature S may be advanced between opposing belts 1, 101 or 1', 101' without imparting a force to the signature S which could cause buckling or wrinkling.

Figure 5:
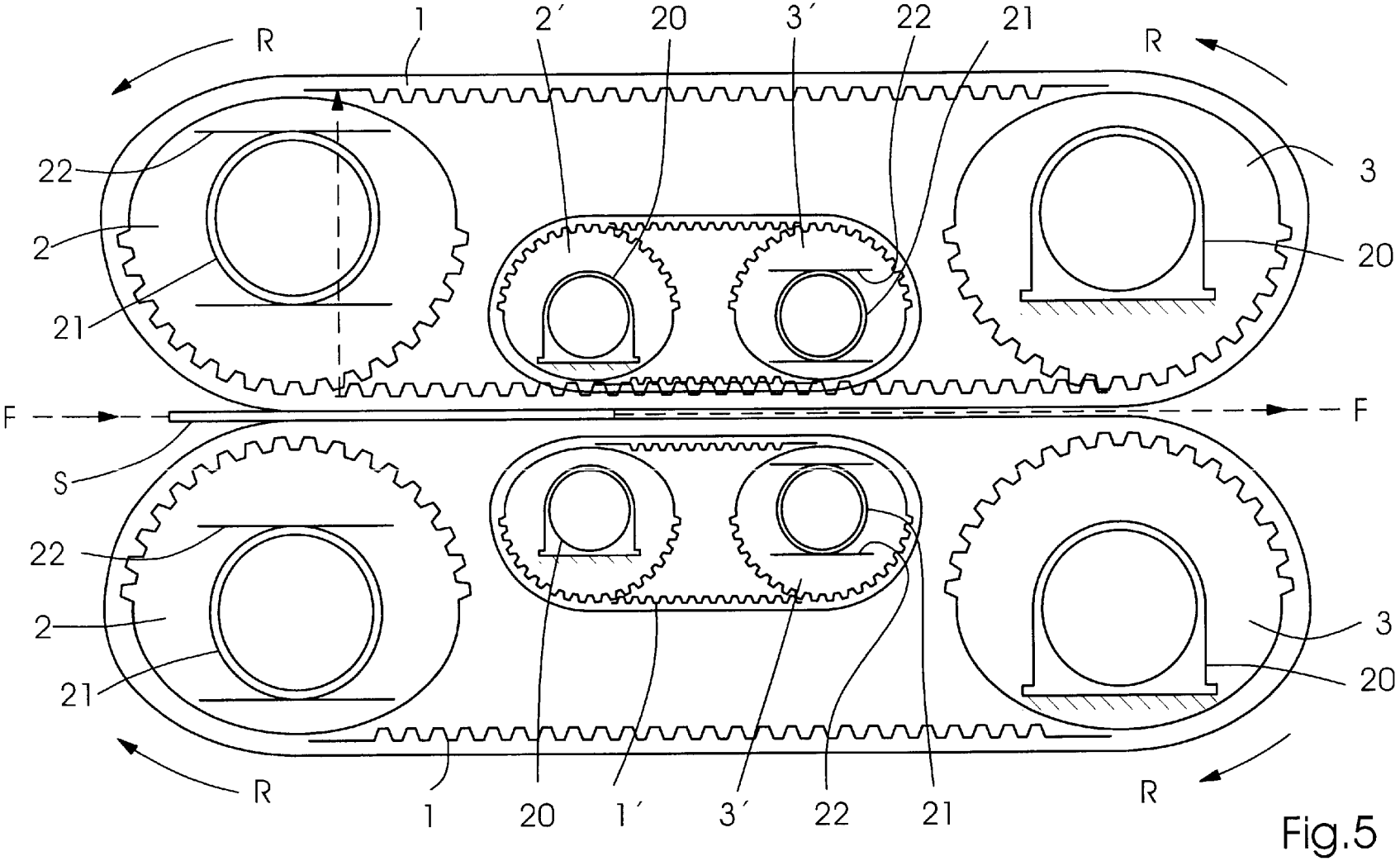
FIG. 5 shows an elevation view of a third embodiment of belts and drives of the present invention advancing a signature.

FIG. 5 shows an alternative embodiment of the present invention. In the arrangement of FIG. 5, the slower, second aligned opposing belts 1' are located inside the faster, first opposing belts 1. As with the arrangement of FIG. 2, the first opposing belts 1 are driven 180° out of phase with the second aligned opposing belts 1', so that the first opposing belts 1 grip the signature when the second aligned opposing belts 1' are retracted, and vice versa.

Figure 6:
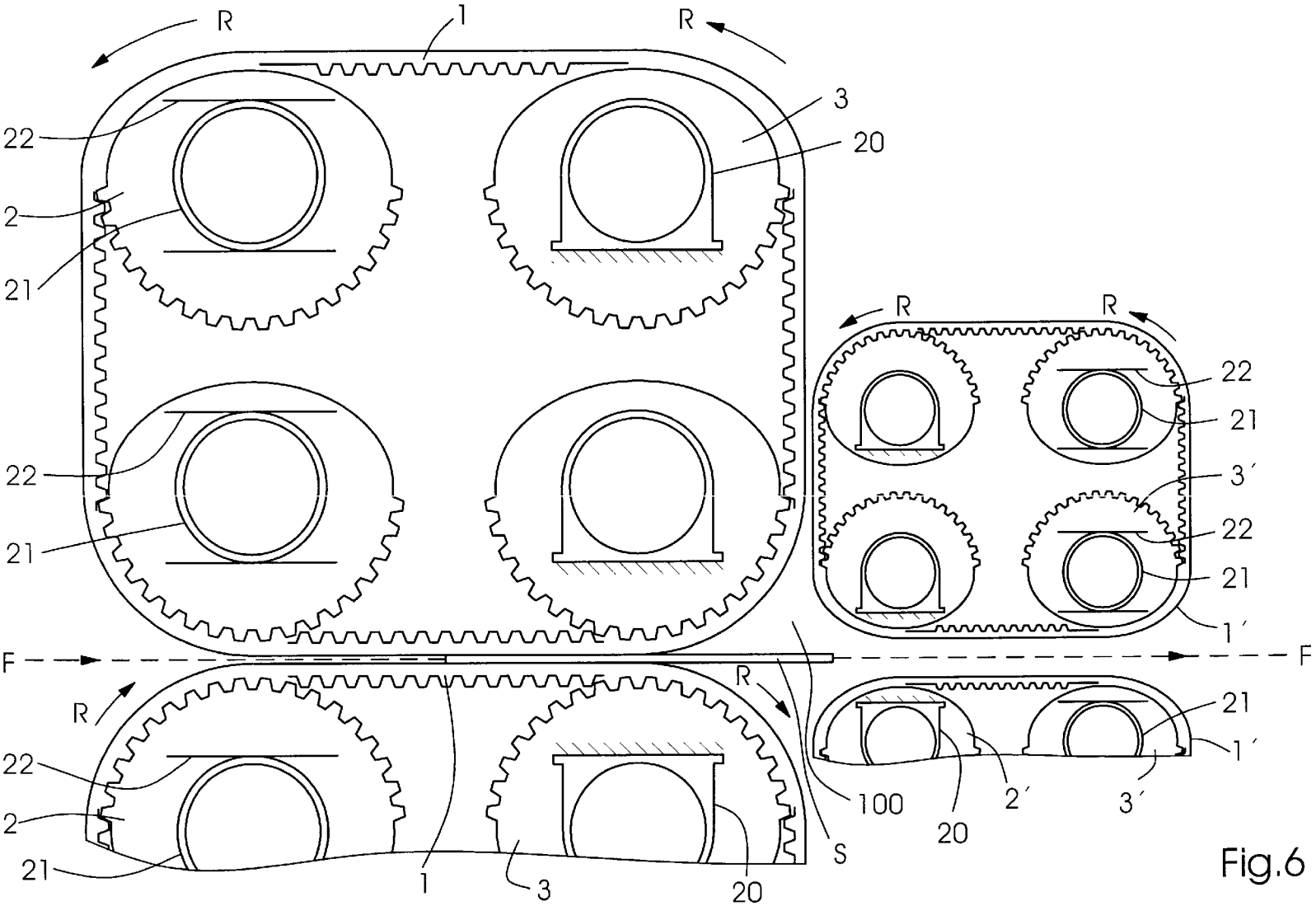
FIG. 6 shows a partial elevation view of a fourth embodiment of belts and drives of the present invention advancing a signature;.

FIG. 6 shows a further alternative embodiment of the invention. In FIG. 6, the belts 1, 1' are fitted over a series of four sprockets 2, 3 or 2', 3'. As may be seen in FIG. 6, the first sprockets 2, 3 are all in phase with one another and are also 180° out of phase with the second sprockets 2', 3'. In all other respects, the embodiments of FIGS. 2 and 6 are the same in structure and operation. In the embodiment of FIG. 2, the lower belts 1, 1' could be driven by semi-elliptical sprockets in the same manner as the upper belts 1, 1', or the lower belts 1, 1' could be driven by standard, circular sprockets like those in the lower half of FIG. 4.

Figure 7:
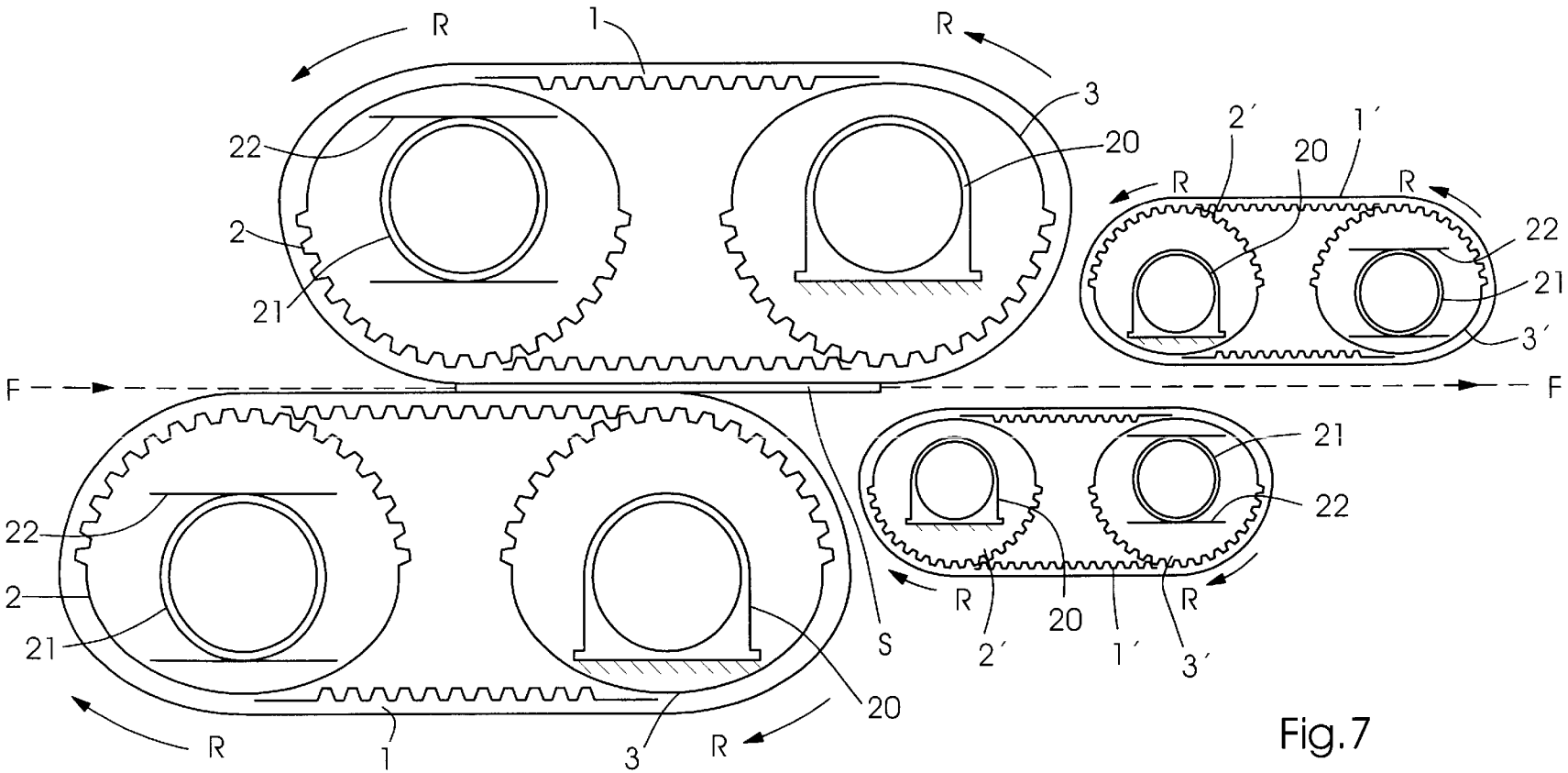
FIG. 7 shows an elevation view of a fifth embodiment of belts and drives of the present invention advancing a signature.
Figure 8:
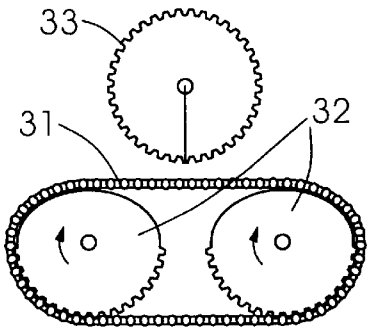
FIGS. 8–12 show the sequence of operation of an intermittent drive arrangement of the present invention.
Figure 9:
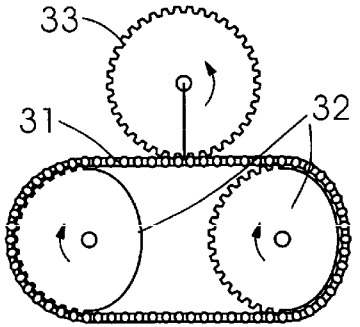
Figure 10:
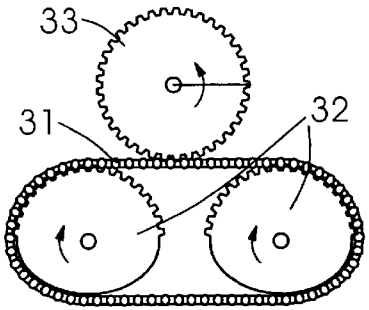
Figure 11:
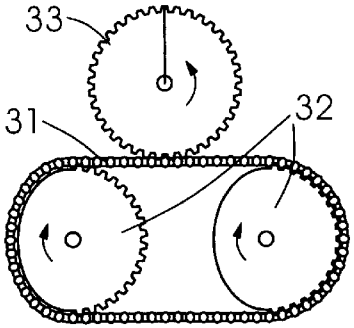
Figure 12:
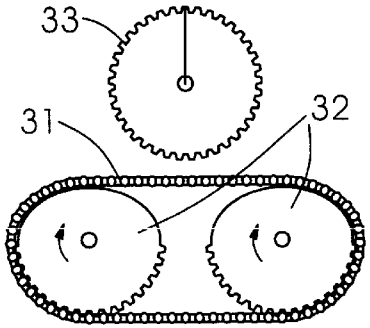

FIG. 7 shows a further alternative embodiment of the present invention. In FIG. 7, the upper and lower belts 1, 1' are laterally offset from one another in the direction F. As a result of the arrangement of FIG. 7, an S-wrap is created along the length of the signature S as it passes along the direction F. This S-wrap is advantageous in that it allows the signature advancing mechanism to compensate for different thicknesses of the folded signature S.

The present invention is particularly adapted for providing additional diversion paths for the signatures S which extend away from, or to the side of, the path F. Such paths could be provided by any suitable diverting or grasping mechanism, or additional retracting belt drives, which changes the direction of the signature S when the belts 1 or 1' are in a retracted or unengaged position, so that the signature S is free for movement in any direction to which it is diverted.

FIGS. 8–12 show an arrangement whereby a drive mechanism according to the present invention can be used for intermittent advancement of a driven sprocket 33. In the embodiment of FIGS. 8–12, a chain 31 (or alternatively, a toothed belt with teeth on both sides) is driven by the sprockets 32, which are identical in design to the sprockets 2, 3 in FIG. 1. As can be seen in the sequence shown in FIGS. 8–12, the chain 31 intermittently engages the driven sprocket 33, thereby rotationally driving the driven sprocket 33 in an intermittent fashion. The arrangement shown in FIGS. 8–12 therefore acts as an intermittent drive mechanism for a shaft connected to driven sprocket 33, in the same manner that a Geneva mechanism can provide intermittent motion to a shaft. As will be appreciated, in the embodiment shown in FIGS. 8–12, the driven sprocket 33 is driven one-half a turn for every one turn of the sprockets 32. The amount by which the driven sprocket 33 is driven for every one turn of the sprockets 32 will be dictated by the diameter ratio of the driven sprocket 33 to the sprockets 32. Therefore, the driven sprocket 33 can be driven in any desired intermittent motion by choosing the appropriate diameter ratios between the driven sprocket 33 and sprockets 32.

In the above description of the invention, those skilled in the art will perceive improvements, changes and modifications. Improvements, changes and modifications within the skill of the art are intended to be covered by the claims.

What is claimed is:

1. An apparatus for advancing an item, comprising:

a flexible mechanical element;

at least two sprockets, the at least two sprockets having teeth around a first portion of a periphery of the at least two sprockets, the teeth of the at least two sprockets having a bottom, the periphery of the at least two sprockets having a second portion with a minimum radial surface distance which is less than a minimum radial surface distance of the bottom of the teeth of the at least two sprockets, the flexible mechanical element being driven by the at least two sprockets;

wherein the second portion is without teeth.

2. The apparatus of claim 1, wherein:

the flexible mechanical element is a belt having teeth.

3. The apparatus of claim 2, further comprising:

an opposing belt, the opposing belt having teeth;

at least two opposing sprockets, the at least two opposing sprockets having teeth around at least a portion of a periphery of the at least two opposing sprockets, the opposing belt being driven by the at least two opposing sprockets, the item being advanced between the belt and the opposing belt.

4. The apparatus of claim 3, wherein:

the teeth of the at least two opposing sprockets extend around an entire periphery of the at least two opposing sprockets.

5. The apparatus of claim 3, wherein:

the teeth of the at least two opposing sprockets have a bottom, the periphery of the at least two opposing sprockets having another portion with a minimum radial surface distance which is less than a minimum radial surface distance of the bottom of the teeth of the at least two opposing sprockets.

6. The apparatus of claim 5, wherein:

the another portion of the at least two opposing sprockets is semi-elliptical.

7. The apparatus of claim 3, wherein:

the belt is laterally offset from the opposing belt.

8. The apparatus of claim 1, wherein:

the at least two sprockets include four sprockets.

9. The apparatus of claim 1, wherein:

the second portion is semi-elliptical.

10. The apparatus of claim 1, wherein:

the at least two sprockets are in phase with each other.

11. The apparatus of claim 1, further comprising:

a drive, the drive driving the at least two sprockets at the same rotational speed.

12. The apparatus of claim 11, further comprising:

a drive belt, the drive belt connecting the drive to the at least two sprockets.

13. The apparatus of claim 1, wherein:

one of the at least two sprockets is mounted in a fixed bearing, and another of the at least two sprockets is mounted in a movable bearing.

14. The apparatus of claim 1, further comprising:

a third sprocket, and wherein the flexible mechanical element mates with and advances the third sprocket.

15. An apparatus for advancing a signature, comprising:

a first belt, the first belt having teeth;

at least two first sprockets, the at least two first sprockets having teeth around a first portion of a periphery of the at least two first sprockets, the teeth of the at least two first sprockets having a bottom, the periphery of the at least two first sprockets having a second portion with a minimum radial surface distance which is less than a minimum radial surface distance of the bottom of the teeth of the at least two first sprockets, the first belt being driven by the at least two first sprockets;

a second aligned belt, the second aligned belt having teeth;

at least two second sprockets, the at least two second sprockets having teeth around a portion of a periphery of the at least two second sprockets, the second aligned belt being driven by the at least two second sprockets, the first and second aligned belts advancing signatures.

16. The apparatus of claim 15, wherein:

the teeth of the at least two second sprockets have a bottom, the periphery of the at least two second sprockets having another portion with a minimum radial surface distance which is less than a minimum radial surface distance of the bottom of the teeth of the at least two second sprockets.

17. The apparatus of claim 15, wherein:

the at least two first sprockets include four sprockets.

18. The apparatus of claim 15, wherein:

the second portion of the at least two first sprockets is semi-elliptical.

19. The apparatus of claim 15, wherein:

the at least two first sprockets are in phase with each other.

20. The apparatus of claim 15, further comprising:

a drive, the drive driving the at least two first sprockets at the same rotational speed.

21. The apparatus of claim 20, further comprising:

a drive belt, the drive belt connecting the drive to the at least two first sprockets.

22. The apparatus of claim 20, wherein:

the drive drives the at least two second sprockets at the same rotational speed as the rotational speed of the at least two first sprockets.

23. The apparatus of claim 22, wherein:

the teeth of the at least two first opposing sprockets extend around an entire periphery of the at least two first opposing sprockets.

24. The apparatus of claim 15, further comprising:

a first opposing belt, the first opposing belt having teeth;

at least two first opposing sprockets, the at least two first opposing sprockets having teeth around at least a portion of a periphery of the at least two first opposing sprockets, the first opposing belt being driven by the at least two first opposing sprockets, the signature being advanced between the first belt and the first opposing belt.

25. The apparatus of claim 24, wherein:

the teeth of the at least two first opposing sprockets have a bottom, the periphery of the at least two first opposing sprockets has another portion with a minimum radial surface distance which is less than a minimum radial surface distance of the bottom of the teeth of the at least two first opposing sprockets.

26. The apparatus of claim 25, wherein:

the another portion of the at least two first opposing sprockets is semi-elliptical.

27. The apparatus of claim 24, wherein:

the first belt is laterally offset from the first opposing belt.

28. The apparatus of claim 15, wherein:

one of the at least two first sprockets is mounted in a fixed bearing, and another of the at least two first sprockets is mounted in a movable bearing.

29. The apparatus of claim 15, wherein:

the at least two second sprockets are out of phase with the at least two first sprockets.

30. The apparatus of claim 15, wherein:

the second aligned belt is located inside the first belt.

* * * * *